US006086397A

United States Patent [19]

Chapman et al.

[11] Patent Number: 6,086,397

[45] Date of Patent: Jul. 11, 2000

[54] HIGH RELIABILITY RAISED FLOOR POWER STRIP

[75] Inventors: Roy Chapman, New River; Kent Herrick, Phoenix; Fred Jordan, Glendale, all of Ariz.

[73] Assignee: American Express Travel Related Services Company, Inc., New York, N.Y.

[21] Appl. No.: 09/067,200

[22] Filed: Apr. 27, 1998

[51] Int. Cl.[7] ..... H01R 4/60

[52] U.S. Cl. ..... 439/214; 439/216

[58] Field of Search ..... 439/502, 500, 439/189, 214, 650, 652, 653, 654, 535, 216

[56] References Cited

U.S. PATENT DOCUMENTS

| | | | |
|---|---|---|---|
| D. 216,887 | 3/1970 | Kahn . | |
| D. 217,251 | 4/1970 | Kahn . | |
| D. 290,835 | 7/1987 | Lovett et al. . | |
| D. 304,324 | 10/1989 | Lovett et al. . | |
| D. 350,916 | 9/1994 | Rossman et al. . | |
| D. 350,917 | 9/1994 | Rossman et al. . | |
| D. 354,731 | 1/1995 | Lee . | |
| D. 356,544 | 3/1995 | Fladung . | |
| 3,707,697 | 12/1972 | Izumi . | |
| 4,100,426 | 7/1978 | Baranowski et al. | 307/41 |
| 4,113,334 | 9/1978 | Instone . | |
| 4,318,156 | 3/1982 | Gallagher | 361/358 |
| 4,395,640 | 7/1983 | Bone . | |
| 4,427,253 | 1/1984 | Smith et al. | 339/98 |
| 4,684,186 | 8/1987 | Hetherington . | |
| 4,705,342 | 11/1987 | Schwartz . | |
| 4,876,713 | 10/1989 | Crosby et al. . | |
| 4,930,047 | 5/1990 | Peterson | 361/395 |
| 5,157,273 | 10/1992 | Medendorp et al. . | |
| 5,164,609 | 11/1992 | Poppe et al. . | |
| 5,278,771 | 1/1994 | Nyenya . | |
| 5,292,257 | 3/1994 | Milan . | |
| 5,334,033 | 8/1994 | Milan . | |
| 5,347,167 | 9/1994 | Singh . | |
| 5,350,310 | 9/1994 | Chen | 439/188 |
| 5,359,540 | 10/1994 | Ortiz . | |
| 5,424,903 | 6/1995 | Schreiber . | |
| 5,429,518 | 7/1995 | Chen | 439/188 |
| 5,430,598 | 7/1995 | Rodolfo et al. . | |
| 5,463,663 | 10/1995 | Maruyama et al. | 375/356 |
| 5,579,201 | 11/1996 | Karageozian | 361/119 |
| 5,582,522 | 12/1996 | Johnson . | |
| 5,649,839 | 7/1997 | Yu . | |
| 5,658,158 | 8/1997 | Milan . | |
| 5,780,775 | 7/1998 | Yu | 174/134 |

*Primary Examiner*—Lincoln Donovan
*Assistant Examiner*—Chandrika Prasad
*Attorney, Agent, or Firm*—Snell & Wilmer L.L.P.

[57] ABSTRACT

A power strip is disclosed with an access panel which is situated and designed such that upon its removal, a sensor may be readily attached and the current load monitored. The access panel is arranged such that the receptacles, the power strip itself, or any of the electrical devices connected to the power strip do not need to be powered down to access the internal circuitry. The "back-wiring" design of the present invention allows for the replacement of any receptacle without interrupting the flow of electrical current to the remaining receptacles. The "back-wiring" design ensures the electrical load is evenly distributed across all the receptacles while providing a secondary path by which the electrical current may reach the receptacles. Thus, the disruption of electrical current across one wire will not result in the disruption of electrical current to any receptacle. Additionally, protective cover plates are utilized to prevent the unauthorized insertion of electrical cords into a power strip.

7 Claims, 4 Drawing Sheets

HIGH RELIABILITY RAISED FLOOR POWER STRIP

TECHNICAL FIELD

The present invention generally relates to an improved power strip, and more particularly, to a power strip which provides for the direct measuring of current loads at the power strip and the removal of a receptacle from the power strip without interrupting power to the remaining receptacles. The present invention further provides a cover plate which substantially reduces the inadvertent insertion of electrical plugs into available receptacles, thereby reducing the possibility that the power strip is electrically overloaded.

BACKGROUND OF THE INVENTION

With the advent of networked stand-alone computer work stations, a need has arisen for efficient, reliable, and cost effective power sources from which workstations and their associated peripheral equipment may receive electrical power. Since each work station may be required to process hundreds of transactions a minute, many businesses typically attempt to avoid equipment downtime. Hence, numerous methods of providing power to workstations have been developed.

One approach for providing highly reliable power to workstations is via direct wiring from a central power distribution box protected by circuit breakers. In this approach, a common three wire bundle is often strung from a circuit breaker to a receptacle. The receptacle typically provides the needed electrical connectivity for one or two pieces of equipment, and the circuit breaker usually prevents the circuit from being overloaded. Clearly, this approach often provides the highest reliability, as each work station is powered by a dedicated wire. However, as additional equipment is added to a work station, the power needs at a particular location may change such that additional receptacles are needed, thereby typically requiring the stringing of additional power lines and other required components. Thus, the direct wiring method often proves to be cumbersome, expensive, and inefficient.

Another approach at providing power to workstations is via power strips. Power strips commonly provide multiple receptacles which are connected in series to a commonly provided 110 volt electrical receptacle. Often these power strips are limited to 15 amps and may provide only 6 receptacles. While currently available power strips address the need to connect multiple pieces of equipment to a common electrical source, many drawbacks still typically exist.

One problem with currently available power strips is the inaccessibility of the internal wiring which commonly increases the difficulty in preforming load determinations. Load determinations are important because often it may be necessary to power additional electrical components via a power strip which is already providing electrical power to other vital components. Since the addition of a single component may overload a power strip, flip a circuit breaker, power off critical equipment, and ultimately result in hundreds or even thousands of lost transactions, system integrators are extremely cautious when connecting additional electrical components to a power strip already in use. As such, system integrators are often required to measure the load upon a circuit before connecting additional components. Since the load upon a power strip may not be directly measured by placing a suitable sensor around the wire bundle which connects the power strip with a host electrical receptacle, a direct measurement must often be made by accessing a power distribution panel, removing the panels covers, and determining the electrical current load at a specific circuit breaker. However, this approach, while effective, is extremely time consuming, and raises unique safety concerns. Since the electrical power present at a central power distribution system may be lethal if the wrong nodes are touched by a hand, screw driver, or the like, this approach (to ensure safety) often requires a certified electrician to access the circuit breaker and determine power loads whenever an additional electrical component needs power.

Since it is often highly undesirable to access the internal wiring of a circuit breaker to determine the load upon a particular power strip, a power strip with a removable cover would be extremely beneficial. Numerous patents have generally disclosed removable covers on power strips, such as the approach disclosed in U.S. Pat. No. 4,930,047, issued May 29, 1990 to Gerald E. Peterson, and titled "APPARATUS FOR INTERCONNECTING COMPONENTS OF A POWER OUTLET STRIP". While the Peterson patent generally discloses a removable bottom cover which, upon removal, reveals the component parts necessary to provide electrical power to a plurality of receptacles, this approach does not allow for the internal wiring to be accessed and the current load determined while continuing to provide electricity to the connected components. In fact, the Peterson patent requires the top cover to be pried from the bottom cover in order to access the internal components. As such, a system integrator would most likely find it extremely difficult to pry the top cover away from the bottom cover while continuing to provide electrical power to connected components.

Similarly, U.S. Pat. No. 4,705,342, issued Nov. 10, 1987 to Frederick W. Schwartz, titled "ELECTRICAL EXTENSION OUTLET", generally discloses a power strip wherein a top cover is snapped into a middle piece which is fastened to a bottom cover. Moreover, the electrical components are primarily secured to the top cover and the middle piece while the bottom cover connects the power strip to a mounting surface. As such, in order to access the internal wiring, the Schwartz patent requires either the power strip to be removed from the mounting surface and the fasteners connecting the bottom cover to the middle piece removed thereby exposing the internal wiring, or the top cover pried from the middle piece and the internal wiring thereby exposed. Either of these approaches would probably be extremely cumbersome and time consuming and next to impossible when electrical components are plugged into and receiving power from the power strip. As such, a power strip which allows for easy access to internal wiring such that electrical current loads may be determined without interrupting the provision of electricity is needed.

Another problem with currently available power strips is the uneven loading of electrical current upon the receptacles. A power strip is typically designed such that the first receptacle is connected to the incoming power source and each subsequent receptacle is connected thereafter in series. As such, the first receptacle will experience the current load of the subsequent receptacles. For example, if a power strip contains 10 receptacles connected in series, each drawing a maximum 1.5 amps, the receptacle closest to the incoming power source will experience 15 amps upon it.

This high current source may result in excessive current entering equipment attached to this first receptacle, or may result in the receptacle "burning out". As a result, numerous approaches have attempted to address this uneven current loading by providing a common bus connected in parallel to a plurality of receptacles. One such approach is disclosed in U.S. Pat. No. 4,113,334, issued on Sep. 12, 1978 to John C. Instone, titled "ELECTRICAL OUTLET STRIP". The Instone patent discloses a wire connected in parallel to a series of leads such that the incoming power will come into contact simultaneously with the leads connected to each receptacle. As such, this approach primarily depends upon one common bus wire to carry all the current for the receptacles. Should this common bus wire fail for whatever reason, all the power to the receptacles downstream of the failure may be interrupted. Since reliable, evenly distributed, electrical power is critical in computer operations centers. a power strip which does not rely upon a single bus bar or wire is needed.

Another concern with power strips designed for the computer workstation environment is that the power strip does not allow the electrician to replace a malfunctioning receptacle without having to shut off power to the remaining receptacles. As mentioned, eliminating power for just a few minutes or seconds could be devastating to the operations of a business. U.S. Pat. No. 4,318,156, issued Mar. 2, 1982 to Michael J. Gallagher, titled "Portable Distribution Box" generally discloses a related system. The Gallagher patent discloses a plurality of receptacles which are connected via a circuit breaker, contained within the "Power Distribution Box", to a power cord receiving power from an external source. Each receptacle may be individually turned on or off by flipping an associated switch. While this approach provides for the removal of a receptacle by flipping the associated switch to the off position, it commonly does so at great expense. The Gallagher approach specifies a circuit breaker, a switch, and a pilot (or similar indicator light) which, if utilized in a large computer workstation environment, may be cost prohibitive, and time consuming and expensive to repair. Thus, an inexpensive and electrically simple power strip is needed which allows for a receptacle to be replaced without interrupting the provisioning of electrical power to the remaining receptacles.

Another attempt at providing a power strip which allows for the replacement of a single receptacle without disrupting the power to the remaining receptacles is disclosed in U.S. Pat. No. 5,350,310, issued Sep. 27, 1994 to Ken-Ching Chen, titled "Socket Terminal", and in U.S. Pat. No. 5,429,518, also issued on Jul. 4, 1995 to Ken C. Chen, titled "Socket Terminal". Both of these patents disclose a power strip wherein each receptacle is positioned above a common bus bar from which metal tabs extend. As each receptacle is rotated clockwise, the connector portions of the receptacle comes into contact with the tabs extending from the corresponding bus bars, thereby completing an electrical connection. Similarly, by rotating each receptacle counterclockwise, a receptacle's connectors will be removed from contact with the tabs, thereby disrupting the electrical connection with that receptacle. In actuality, however, the Chen approaches depend upon a common bus, and the extension of tabs therefrom, such that whenever a tab may fail for whatever reason, the entire bus would probably have to be powered down to allow reattachment of a tab, by soldering or the like, to the bus. Additionally, the replacement of a single receptacle may result in the displacement of the remaining receptacles because each receptacle is retained by a flange in contact with the top cover of the power strip. As the top cover is removed, each receptacle is no longer securely positioned. In order for receptacles to be removed from a Chen patented device, the power strip would probably have to lay flat on its bottom surface (i.e. it could not be vertically positioned, or be positioned on its side), and the top cover carefully removed such that none of the remaining receptacles were dislodged. Thus, the Chen patents do not disclose a power strip which allows the replacement of a receptacle without interrupting the power provided to the remaining receptacles.

Another problem frequently encountered when power strips are utilized in computer workstation environments, is the overloading of the circuit due to additional equipment being plugged into the power strip. Often radios, clocks, fans, and similar electrical components are plugged into the nearest available electrical outlet which may be a power strip whose receptacles are not all being used. The mere fact that all the receptacles in a power strip are not being used does not mean the power strip can carry additional electrical loads. Workers are often ignorant of this fact, and occasionally plug components into the fully loaded power strip which overloads the circuit, trips the breaker, and catastrophically powers down critical equipment receiving electricity from the power strip. Thus, a power strip which strictly limits access is needed.

Therefore, it can be appreciated that there exists a need for a power strip which allows for the easy determination, at the power strip itself, of the current being drawn by the attached equipment, while providing a highly reliable, evenly distributed current load across a plurality of receptacles, and allows the replacement of a receptacle without interrupting the power being provided to the remaining receptacles.

SUMMARY OF THE INVENTION

The present invention addresses the shortcomings of the prior art and provides a power strip specifically designed for the mass computer work station environment, but adaptable for other uses including telecommunications equipment racks, electronic equipment racks, and any situation wherein multiple electronic devices may be connected to a common electrical circuit.

More specifically, the present invention provides a power strip which contains an access panel situated on the top of the power strip, directly above the entry point of an electrical cord. The access panel is situated and designed such that upon its removal, the line wire (the wire providing the electrical current) may be suitably positioned such that a sensor may be readily attached, and the current load monitored. Additionally, the access panel is arranged such that none of the receptacles, the power strip itself, nor any of the electrical devices connected to the power strip need be powered down to access the internal circuitry. Additionally, the access panel is designed such that a licensed electrician is not needed to determine the electrical current passing through the power strip.

Another advantage of the present invention is the "back-wiring" design ensures the electrical load is evenly distributed across all the receptacles while providing a secondary path by which the electrical current may reach the receptacles. By electrically connecting the receptacle furthest from the power cord directly with the incoming electrical lines, while also directly connecting the receptacle closest to the power cord with the incoming electrical lines, and connecting each of the receptacles therebetween in series such that an electrical loop is created, the electrical current may be evenly distributed across a plurality of receptacles. Additionally, the "back-wiring" design of the present invention provides a redundant electrical path to each of the receptacles. Thus, the disruption of electrical current across one wire will not result in the disruption of electrical current to any receptacle.

The present invention also provides a power strip which allows for the replacement of any receptacle without interrupting the flow of electrical current to the remaining receptacles. Each receptacle is securely fastened to the top cover and sufficient slack is provided in the electrical wiring such that the top cover may be removed without having to detach the power strip from a mounting surface or having to unplug any of the attached electrical equipment. Once the top cover is removed, the "back-wiring" design allows any single receptacle to be removed without significantly interrupting the provision of electricity to the remaining receptacles.

In another embodiment of the present invention, protective cover plates are utilized to prevent the unauthorized insertion of electrical cords into a power strip. The cover plates are secured to the power strip by a screw requiring a special tool to loosen, thereby reducing unauthorized removal. The cover plate is preferably fastened onto the power strip above the electrical receptacle(s) which are not in use. In this manner, access to the receptacles on a power strip providing electricity to critical components may be strictly controlled.

BRIEF DESCRIPTION OF THE DRAWING FIGURES

The present invention will hereinafter be described in conjunction with the appended drawing figures, wherein like numerals generally denote like elements, and:

DETAILED DESCRIPTION OF PREFERRED EXEMPLARY EMBODIMENTS

An exemplary power strip 1 is disclosed which allows quick and convenient access to a sensor for monitoring current load without the need for powering down the device. Moreover, power strip 1 includes a unique back-wiring design which helps to ensure that the electrical load is substantially evenly distributed across all the receptacles while providing a secondary path by which the electrical current may reach the receptacles, thereby providing for the replacement of any receptacle without interrupting the flow of electrical current to the remaining receptacles.

Figure 1:
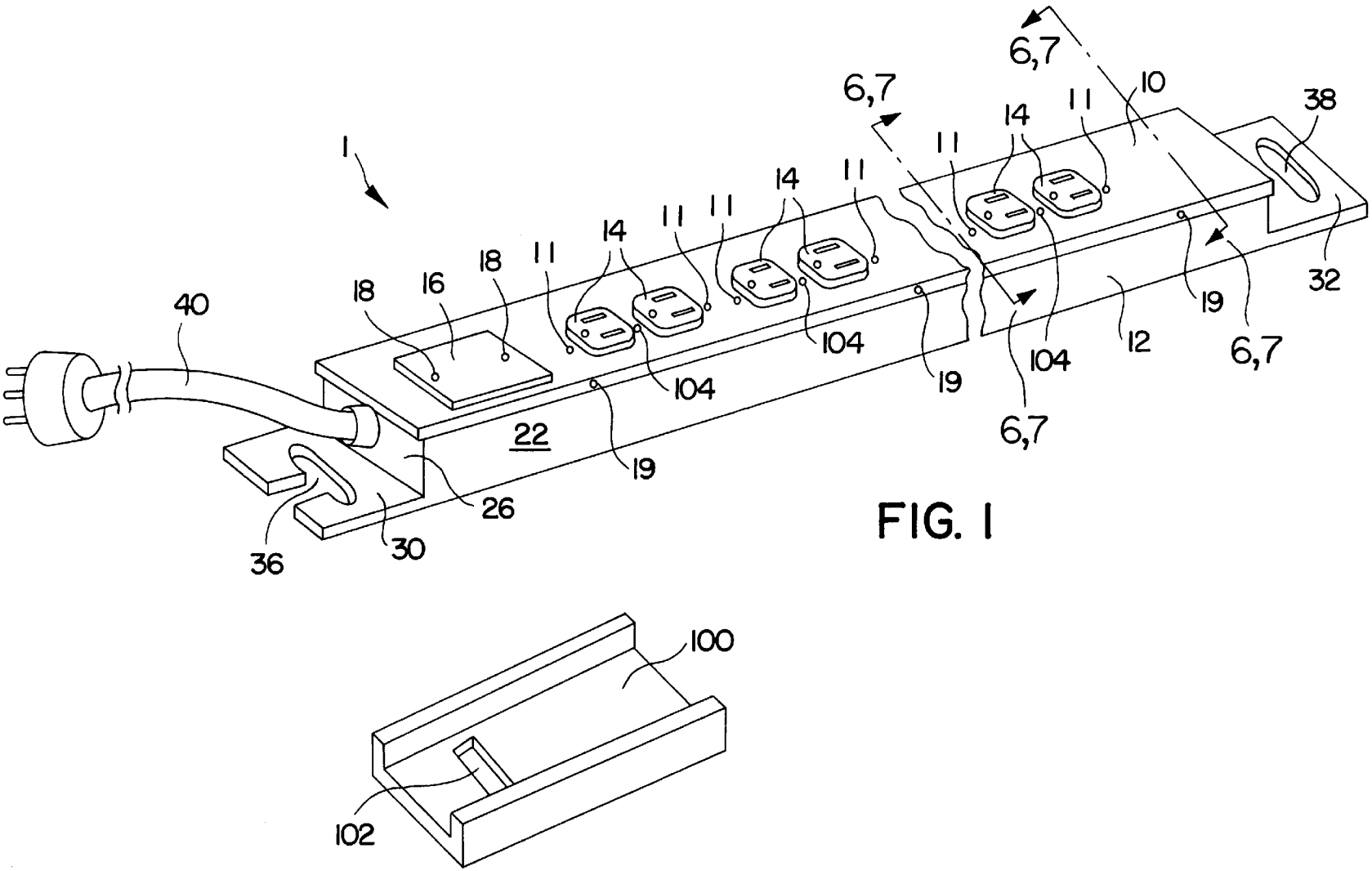
FIG. 1 is a perspective view of a power strip in accordance with an embodiment of the present invention.
Figure 2:
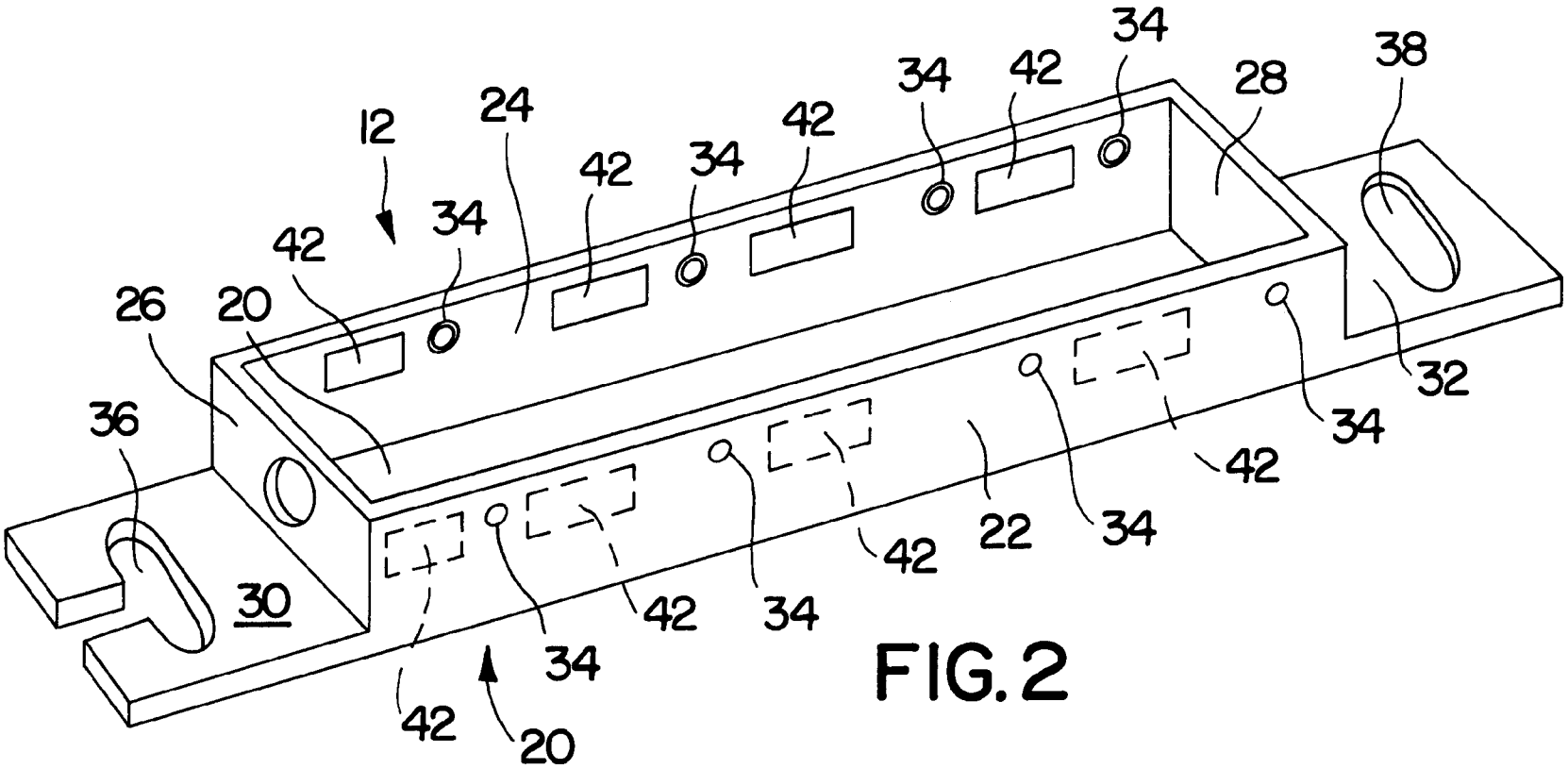
FIG. 2 is a perspective view of a base member in accordance with an embodiment of the present invention.

Referring to FIGS. 1 and 2, power strip 1 includes a means for supporting receptacles, and in a preferred embodiment, a top cover 10 and a base member 12. The base member 12 is preferably formed into an elongated three sided rectangular cavity comprising a bottom 20, first side 22, second side 24, power end 26, distant end 28, power end mounting tab 30, and a distant end mounting tab 32. The power end mounting tab 30 and the distant end mounting tab 32 may be extended by an insert able bracket 100 which inserts the mounting tab 30 or 32 into the hole 102 provided in the bracket 100, thereby extending the reach of the mounting tabs 30 or 32 such that the power strip 1 may be installed in larger openings.

A plurality of holes 34 are suitably situated in the first side 22 and second side 24 for securing a fastener inserted therein. The base member 12 is of suitable thickness to provide the necessary structural rigidity for the power strip 1 of the present invention. Materials such as plastic, steel, aluminum or the like may be utilized in forming the base member 12. The base member 12 is suitably grounded if constructed of an electrically conductive material. The power end mounting tab 30 preferably contains a T-notch 36 which facilitates the installation or removal of the power strip. The distant end mounting tab 32 preferably contains an opening 38 which allows a fastener to secure the power strip 1 to a mounting surface.

Located within the top cover 10 is a plurality of electrical receptacles 14, preferably grouped in sets of two. In a preferred embodiment, five sets of two electrical receptacles 14 are provided (although only three sets of receptacles are shown in FIG. 1). It is to be understood that the present invention is not limited to a specific number of electrical receptacles, because any number of receptacles may be utilized in the present invention with the length of the power strip, wire gage utilized, and the like accordingly modified. The electrical receptacles are fastened to the top cover 10 by a set of screws 11 located one on either side of each two set receptacle 14.

An access plate 16 of any size and configuration is suitably attached to top cover 10, preferably by a set of screws 18. Access plate 16 is situated above an opening in cover 10 such that upon removal one may access the wires within the power strip 1 and readily determine the electrical current load by attaching an appropriate sensor (not shown) to the wires providing electricity to the receptacles. Although access plate 16 is attached to top cover 10, one of ordinary skill in the art will appreciate that access plate 16 may be located at any point on power strip 1 which allows access to the wires therein. The provisioning of an access plate 16, preferably above the entrance location of the hot line 44, neutral line 46, and ground line 48 from the power cord 40, allows an operator to attach an appropriate sensor upon the hot line 44 and determine the electrical current being drawn real-time by the equipment connected to the power strip 1. The present invention merely requires the removal of two screws 18 or the like, does not require the insertion of tools into high potential environments, nor require direct contact with any live electrical circuits. Thus, the present invention fills a void which exists in the prior art.

In an alternative embodiment of the present invention, the access plate 16 is replaced by a permanently attached current sensor, which includes a surface mounted liquid crystal display or the like. In this embodiment, the current passing through the power strip may be readily and continuously monitored without utilizing any special tools. Additionally, it is to be considered within the scope of the present invention, that such real-time current monitoring may be suitably attached to an appropriate data monitoring device (such as a computer), using known in the art data monitoring techniques.

Returning to the preferred embodiment as depicted in FIGS. 1 and 2, a power cord 40 is suitably fastened to the power end 26. The power cord 40 preferably contains three prongs, one for a hot, neutral, and ground line. The thickness of the electrical insulation, power rating, and construction of the power cord 40 may be varied as necessary to provide sufficient electrical insulation and construction to obtain the desired voltage and current. Situated on the interior of the first side 22 and second side 24 are a plurality of insulating pads 42 which provide electrical and physical separation between the first and second sides 22 and 24 and the electrical receptacles 14 when the top cover 10 is fastened by a plurality of screws 19 to the base member 12. The insulating pads 42 may be removed without departing from the spirit of the present invention when such electrical separation is not required. The power cord 40 is suitably retained in the base member 12.

Figure 3:
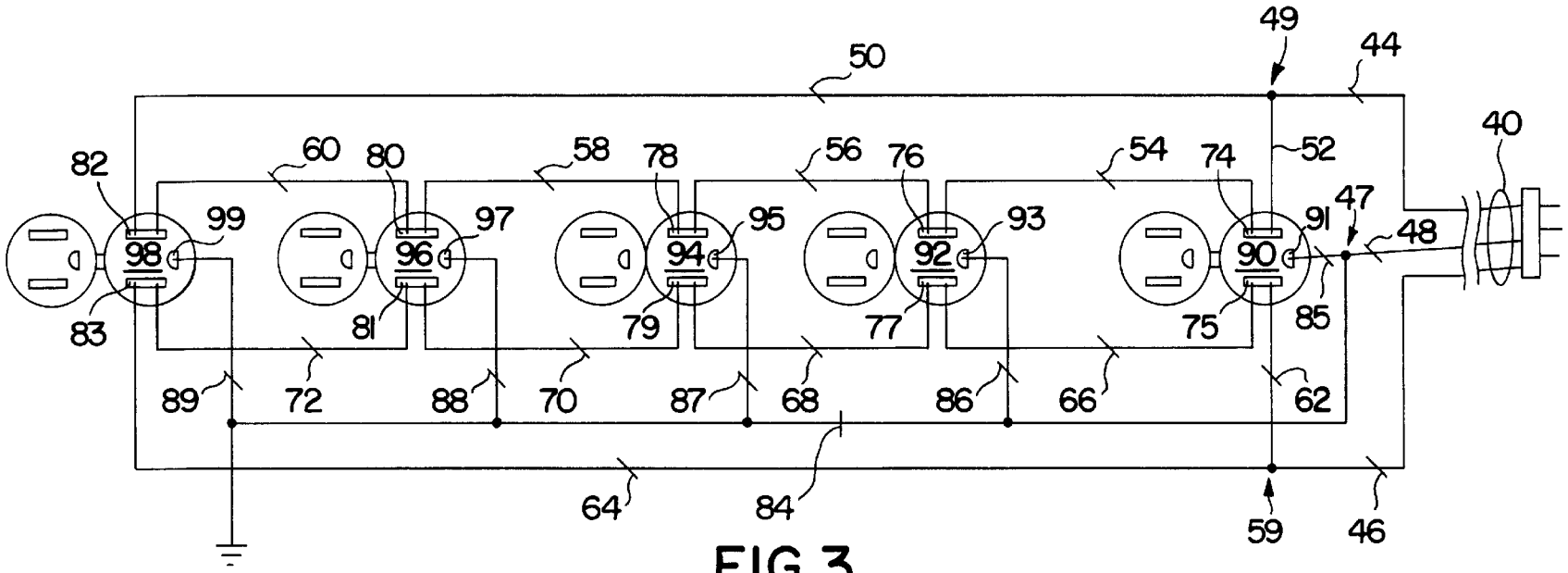
FIG. 3 is an electrical schematic view of an embodiment of the present invention.

Power strip 1 includes any suitable wiring design which helps to ensure that the electrical load is substantially evenly distributed across all the receptacles while providing a secondary path by which the electrical current may reach the receptacles, thereby providing for the replacement of any receptacle without interrupting the flow of electrical current to the remaining receptacles. As shown in FIG. 3, in a preferred embodiment, the "back-wiring" design of the present invention includes a hot line 44, neutral line 46, and a ground line 48 which are extensions of the power cord 40. The hot line 44 is electrically connected at the hot junction 49 to the hot loop wire 50 and to lead 52, which provides electricity to the hot pole 74 of the first receptacle 90. The hot loop wire 50 provides an alternative path for electricity to reach the many receptacles 90, 92, 94, 96, and 98. The hot pole 74 of the first receptacle 90 and the hot pole 76 of the second receptacle 92 are electrically connected via lead 54. Similarly, the hot pole 76 of the second receptacle 92 is electrically connected via lead 56 to the hot pole 78 of the third receptacle 94, which is electrically connected via lead 58 to the hot pole 80 of the fourth receptacle 96, which is electrically connected via lead 60 to the hot pole 82 of the fifth receptacle 98. In this manner, leads 54, 56, 58, and 60 serially connect the hot poles of each receptacle. It is to be noted, that each receptacle 90, 92, 94, 96, and 98, as shown, constitutes two actual receptacles which are tied together as a single unit.

The hot pole 74 of the first receptacle 90 is protected against high currents by the hot loop wire 50 which is directly and electrically connected to the hot pole 82 of the fifth receptacle 98. The hot loop wire 50 provides an alternative path for the current to flow when all the receptacles are interconnected. Since electricity always follows the path of least resistance, the current across the plurality of receptacles will be equalized. That is, under ideal conditions, half the total current needed for all the receptacles will flow from the hot wire 44 via the path created by lead 52 while the other half will flow via the path created by lead 50.

Additionally, the hot loop wire 50 suitably allows each receptacle to be electrically connected to the hot line 44 even if a receptacle or a hot lead is removed. For example, if the second receptacle 92 is removed such that lead 54 is no longer connected in series with lead 56, the third receptacle 94 would still receive electricity via the serial circuit created by lead 50 to lead 60 to lead 58.

Similarly, the same principles apply for the neutral line 46. The neutral line 46 is electrically connected at node 59 to the neutral loop wire 64 and lead 62, which provides a return path for the electricity at the neutral pole 75 of the first receptacle 90. The neutral loop wire 64 provides an alternative path for electricity to reach the many receptacles. The neutral pole 75 of the first receptacle 90 and the neutral pole 77 of the second receptacle 92 are electrically connected via lead 66. Similarly, the neutral pole 77 of the second receptacle 92 is electrically connected via lead 68 to the neutral pole 79 of the third receptacle 94, which is electrically connected via lead 70 to the neutral pole 81 of the fourth receptacle 96, which is electrically connected via lead 72 to the neutral pole 83 of the fifth receptacle 98. In this manner, leads 66, 68, 70, and 72 serially connect the neutral pole of each receptacle.

The neutral loop wire 64 provides an alternative path for the return current to flow when all the receptacles are interconnected. Since electricity always follows the path of least resistance, the current across the plurality of receptacles will be equalized. That is, under ideal conditions half the total return current needed for all the receptacles will flow to the neutral line 46 via lead 62 and the other half via the neutral loop wire 64.

Additionally, the neutral loop wire 64 allows each receptacle 74, 76, 78, 80, and 82 to be electrically connected to the neutral line 46 if a receptacle or a neutral lead is removed. For example, if the second receptacle 76 is removed such that lead 66 is no longer connected in series with lead 68, the third receptacle 78 would still be electrically connected to the neutral line 46 via the serial circuit created by lead 70 to lead 72 to lead 64.

The ground line 48 is connected to the ground leads 84 and 85 at the ground junction. Each receptacle is similarly connected to ground. As shown in FIG. 3, ground leads 85, 86, 87, 88, and 89 are connected to ground poles 91, 93, 95, 97, and 99. Thus, each receptacle 90, 92, 94, 96, and 98 is appropriately grounded. The ground lead 84 may be an electrical wire, grounding bus, chassis of the power strip (if constructed of an electrically conductive metal), and the like. Thus, any grounding source is within the scope of the present invention.

Additionally, every lead, wire, line, and the like specified above is provided with sufficient length such that any receptacle or the top cover 10 may be removed from the power strip 1 without having to cut or disconnect any such leads. Preferably the leads, lines, and such are not shielded wires, however, the present invention may be suitably adapted to encompass shielded lines.

Figure 4:
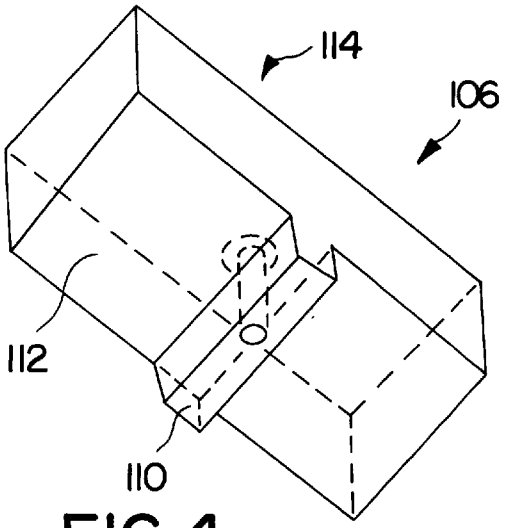
FIG. 4 is a perspective view of a full receptacle cover plate in accordance with an embodiment of the present invention.
Figure 5:
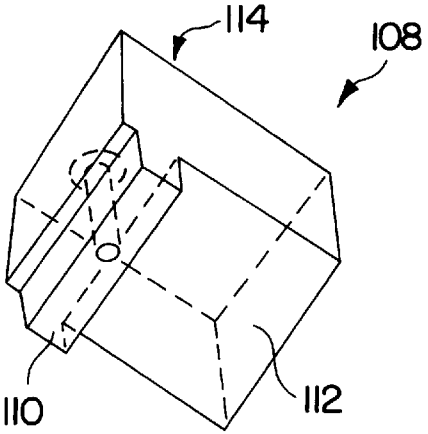
FIG. 5 is a perspective view of a half receptacle cover plate in accordance with an embodiment of the present invention.
Figure 6:
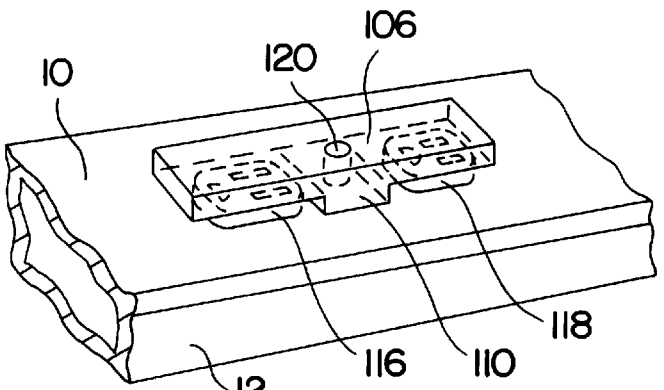
FIG. 6 is a perspective view of a portion of an embodiment of the present invention within the lines A—A and B—B of FIG. 1 showing a full receptacle cover plate suitably inserted above a set of receptacles so as to temporarily prevent access to both receptacles.
Figure 7:
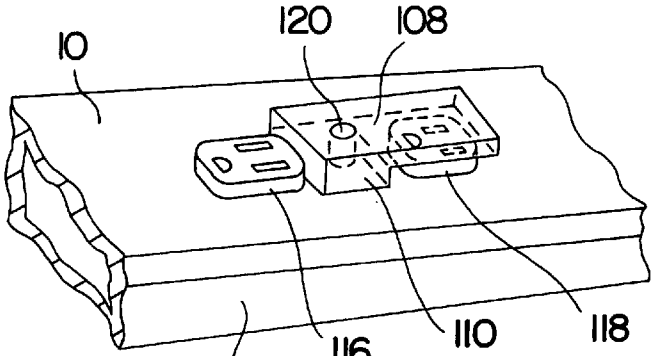
FIG. 7 is a perspective view of a portion of an embodiment of the present invention. within the lines A—A and B—B of FIG. 1 showing a half receptacle cover plate inserted above a set of receptacles so as to temporarily prevent access to one of the receptacles while allowing access to the other.

The power strip 1 of the present invention also prevents the insertion of non-authorized electrical connectors into receptacles 14 which are not already being used, by providing a fastening point 104, as shown in FIG. 1 for either a full receptacle cover plate 106 (FIG. 4) or a half receptacle cover plate 108 (FIG. 5). As shown in FIGS. 4 and 5, each cover plate contains a center ridge 110 which extends from the bottom surface of the cover plate 112. Otherwise, each cover plate 106 or 108 is substantially planar 114, having a top, four sides, and a bottom surface 112. The ridge 110 of the full receptacle cover plate 106, as shown in FIG. 6, preferably rests between a first receptacle 116 and a second receptacle 118, while the substantially planar portion 114 prevents access to the first and second receptacles, 116 and 118 respectively. Similarly, as shown in FIG. 7, the ridge 110 of the half receptacle cover plate 108 preferably rests between the first receptacle 116 and the second receptacle 118. However, the substantially planar portion 114, of the half receptacle cover plate 108, only covers one of the two receptacles, and allows access to the non-covered receptacle. Both the full receptacle cover plate 104 and the half receptacle cover plate 106 are secured to the top cover 10 by a screw 120 or the like. For the preferred embodiment, the screw 120 requires specially designed tools to loosen, thereby discouraging unauthorized removal of the receptacle cover plates.

Although the foregoing description sets forth a preferred exemplary embodiment of the present invention, the scope of the invention is not limited to this specific embodiment. Modifications may be made to the specific form and design of the invention without departing from its spirit or scope as expressed in the following claims.

We claim:

1. A power strip comprising:

a. a support comprising a base and a cover detachably connected to said base, b. a plurality of electrical receptacles connected to said cover, and each of said electrical receptacles being configured to receive a plug from an external device, c. an electric circuit incorporating conductive portions of each of said plurality of receptacles, and d. a power cord for supplying electricity from a source to said electric circuit, said power cord being in circuit communication with said electric circuit;

said receptacles remaining connected with said cover, said electric circuit remaining intact, and said power cord remaining in circuit communication with said electric circuit when said cover is detached from said base, each of said electrical receptacles being selectively detachable from said cover and from said electric circuit when said cover is detached from said base, and said electric circuit being configured to provide current flow to each of said plurality of receptacles and to maintain current flow to the remaining receptacles when a receptacle is detached from said cover and said electric circuit, whereby a receptacle can be selectively detached from said cover and said electric circuit without interrupting the flow of current to the remaining receptacles.

2. A power strip as defined in claim 1, wherein said electric circuit is configured to (i) distribute electric load to each of said plurality of receptacles along a plurality of paths to allow current to flow to each of said plurality of receptacles when all of said plurality of receptacles are connected to said electric circuit, and (ii) provide at least a single path by which current may flow to all remaining receptacles when a receptacle is detached from said cover and said electric circuit.

3. A power strip comprising:

a. a support comprising a base and a cover detachably connected to said base, b. a plurality of electrical receptacles connected to said cover, and each of said electrical receptacles being configured to receive a plug from an external device, c. an electric circuit incorporating conductive portions of each of said plurality of receptacles, and d. a power cord for supplying electricity from a source to said electric circuit, said power cord being in circuit communication with said electric circuit;

each of said electrical receptacles being selectively detachable from said cover and from said electric circuit when said cover is detached from said base;

wherein said electric circuit is configured to (i) distribute electric load to each of said plurality of receptacles along a plurality of paths to allow current to flow to each of said plurality of receptacles when all of said plurality of receptacles are connected to said electric circuit, and (ii) provide at least a single path by which current may flow to all remaining receptacles when a receptacle is detached from said cover and said electric circuit; and wherein said power cord includes a hot wire through which current flows to said electric circuit, said plurality of receptacles including first and second receptacles, said electrical circuit being configured such that (i) said hot wire is connected directly with each of said first and second receptacles, (ii) the remainder of said plurality of receptacles are connected in series with each other, and (iii) each of said first and second receptacles is connected in series with one of the remainder of said plurality of receptacles.

4. A power strip as defined in claim 3, wherein said power cord is connected to a selected location on said support and said first receptacle is connected to said cover at a location proximate to said selected location, said hot wire being disposed in circuit communication with said electric circuit at a location proximate to said selected location, and said cover including an access opening which provides access to said hot wire and said electric circuit proximate to said selected location.

5. A power strip as defined in claim 1, wherein a cover member is provided, and wherein said cover member and said cover are configured such that said cover member can be connected to a selected location on said cover, said cover member being configured to block connection between a plug and at least one selected receptacle when said cover member is connected to said cover.

6. A power strip as defined in claim 5, wherein said plurality of receptacles are configured to form receptacle sets, each of which comprises a pair of receptacles, and said cover member is configured to block connection between a plug and both receptacles of a receptacle set.

7. A method of replacing a receptacle in a power strip wherein said power strip includes a support comprising a base and a cover detachably connected to said base, a plurality of electrical receptacles connected to said cover, each of said electrical receptacles being configured to receive a plug from an external device, an electric circuit incorporating conductive portions of each of said plurality of receptacles, and a power cord for supplying electricity from a source to said electric circuit, said power cord being in circuit communication with said electric circuit, said method comprising the steps of:

a. detaching said cover from said base while said receptacles remain connected to said cover, said electric circuit remains intact, and said power cord remains in circuit communication with said electric circuit, b. selectively detaching at least one of said receptacles from said cover and from said electric circuit while maintaining current flow to each of the remaining receptacles.

* * * * *